US007638720B1

(12) United States Patent
Schimke

(10) Patent No.: US 7,638,720 B1
(45) Date of Patent: Dec. 29, 2009

(54) BED CONTROL DEVICE

(76) Inventor: Clyde V. Schimke, 3086 Pellam Blvd., Port Charlotte, FL (US) 33948

( * ) Notice: Subject to any disclaimer, the term of this patent is extended or adjusted under 35 U.S.C. 154(b) by 648 days.

(21) Appl. No.: 11/401,652

(22) Filed: Apr. 10, 2006

(51) Int. Cl.
*H01H 35/24* (2006.01)
*H01R 24/00* (2006.01)

(52) U.S. Cl. ..... 200/81.8; 200/83 Z; 200/81 R; 200/51.11; 200/52 R

(58) Field of Classification Search ..... 200/6 A, 200/51 R, 51.11, 52 R, 81 R, 81.4, 81.8, 200/83 R, 83 Z, 81 H; 340/573, 626, 825.19; 379/52; 623/24, 26; 212/159, 160, 162–165; 414/909
See application file for complete search history.

(56) References Cited

U.S. PATENT DOCUMENTS 3,798,684 A * 3/1974 Benoit et al. ..... 5/614
4,118,612 A * 10/1978 Gabus ..... 200/81.9 R
4,298,863 A * 11/1981 Natitus et al. ..... 340/573.1
4,307,810 A * 12/1981 Spalluto ..... 212/285
5,155,309 A * 10/1992 Dwyer ..... 200/81 H
5,168,587 A * 12/1992 Shutes ..... 5/81.1 T
5,365,026 A * 11/1994 Cromer et al. ..... 200/1 R
5,592,153 A * 1/1997 Welling et al. ..... 340/825.19
6,481,688 B1 * 11/2002 Welling et al. ..... 248/694
6,674,029 B2 * 1/2004 Okuyama et al. ..... 200/81.4
7,160,133 B2 * 1/2007 Karadimas et al. ..... 439/352
7,395,568 B2 * 7/2008 Damewood ..... 5/722

* cited by examiner

*Primary Examiner*—Michael A Friedhofer

(57) ABSTRACT

A bed control device is disclosed. An illustrative embodiment of a pneumatic bed control device includes a housing, multiple pneumatic switches carried by the housing, a plug connected to the pneumatic switches and multiple puff tubes connected to the pneumatic switches, respectively. A joystick-actuated bed control device is also disclosed.

8 Claims, 4 Drawing Sheets

BED CONTROL DEVICE

FIELD

The present invention relates to automatically controlled beds. More particularly, the present invention relates to a bed control device which can be actuated to control the various positions of an automatically controlled bed.

BACKGROUND

Automatically controlled beds are commonly used in medical facilities such as hospitals, assisted living facilities and the like. Typically, a conventional automatically-controlled bed includes a frame on which is supported a mattress. Electric controls can be used to raise and lower the head and foot portions of the frame and mattress depending on the desires of the user. The bed position controls are typically manually-activated; therefore, it may be difficult or impossible for persons whose arms are immobilized to adjust the positions of the bed when desired.

SUMMARY

The present invention is generally directed to a bed control device. An illustrative embodiment of a pneumatic bed control device includes a housing, multiple pneumatic switches carried by the housing, a plug connected to the pneumatic switches and multiple puff tubes connected to the pneumatic switches, respectively. The invention is further directed to a joystick-actuated bed control device.

BRIEF DESCRIPTION OF THE DRAWINGS

The invention will now be described, by way of example, with reference to the accompanying drawings, in which.

DETAILED DESCRIPTION

Figure 3:
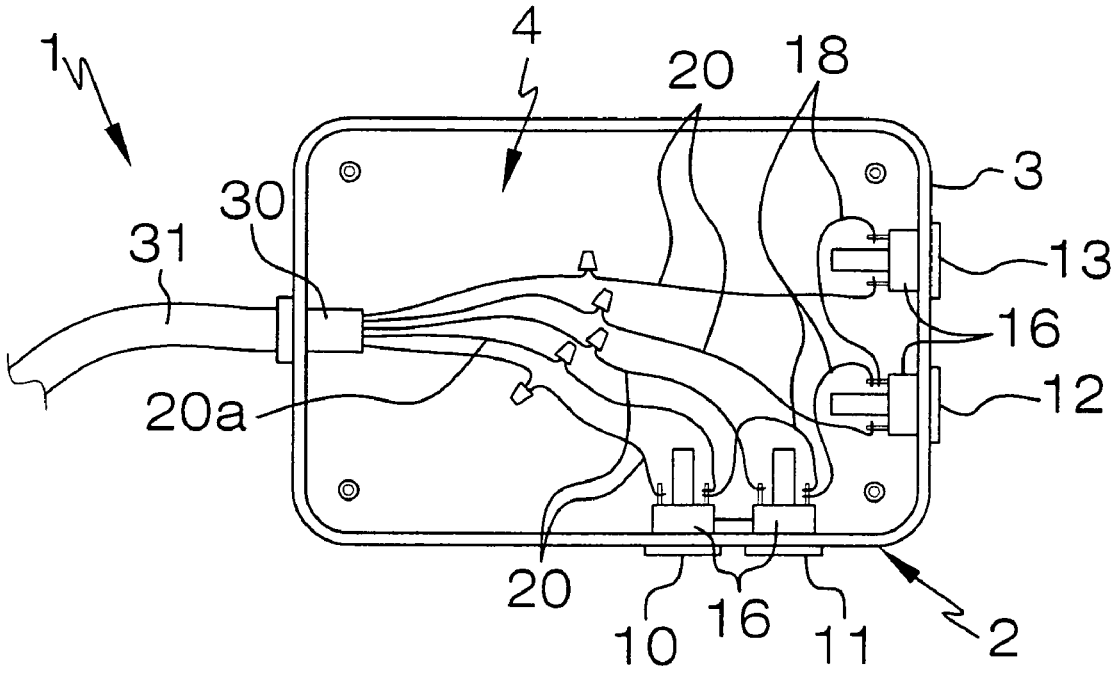
FIG. 3 is an interior view of an illustrative embodiment of a pneumatic bed control device.
Figure 4:
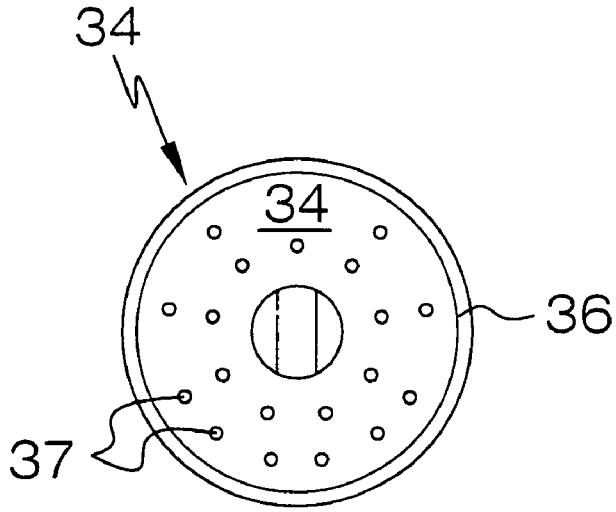
FIG. 4 is a front view of a connection port suitable for connecting a pneumatic bed control device to a bed motor control box of an automatically controlled bed.
Figure 5:
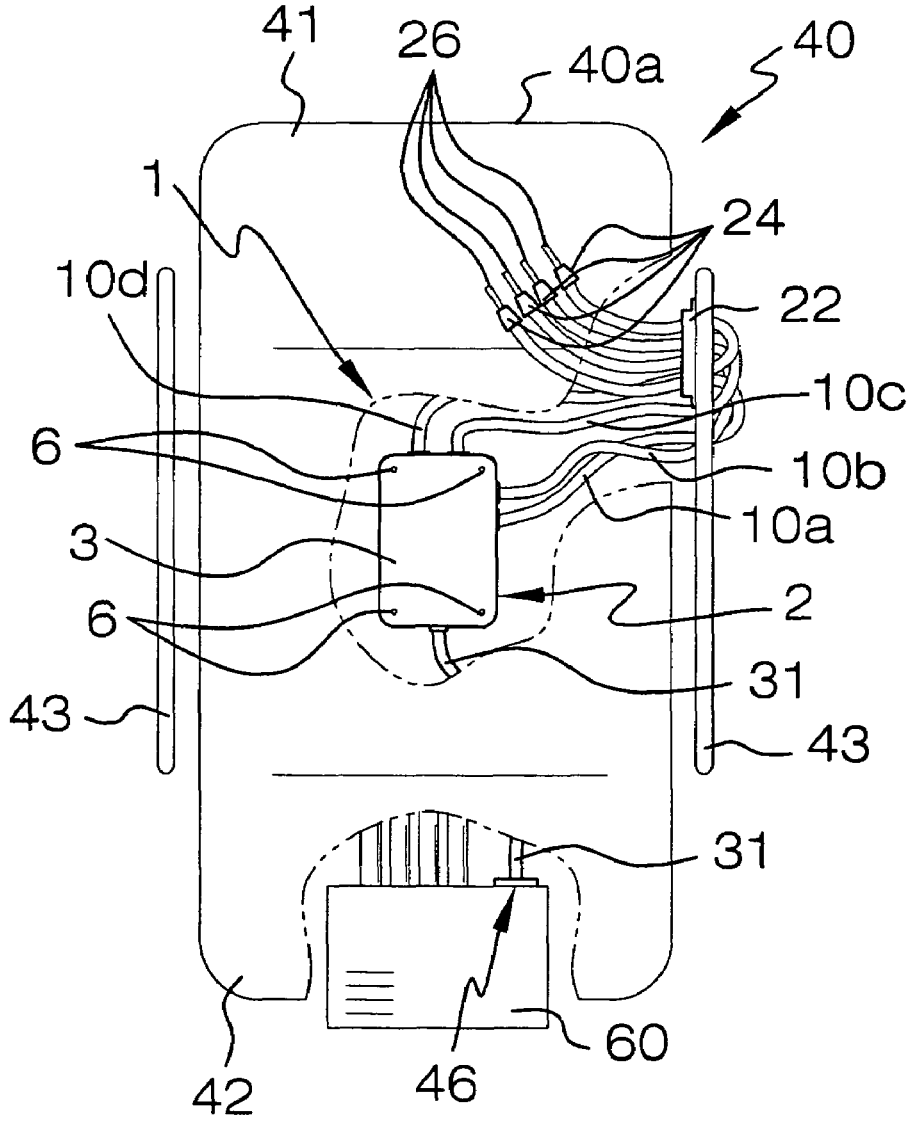
FIG. 5 is a top view, partially in section, of an automatically controlled bed, illustrating an illustrative embodiment of a pneumatic bed control device connected to a bed motor control box of the bed.

Referring to FIGS. 1-5 of the drawings, an illustrative embodiment of a pneumatic bed control device is generally indicated by reference numeral 1. As shown in FIG. 5 and will be hereinafter described, the pneumatic bed control device 1 is adapted for connection to a bed motor control box 60 of an automatically controlled bed 40. The bed 40 typically includes a mattress 40*a* which rests on a bed frame (not shown) and includes a head 41 and a foot 42. The bed 40 includes side rails 43 provided on the bed frame. The bed motor control box 60 is adapted to control various motors (not shown) which facilitate the selective raising and lowering of the head 41 and foot 42 of the bed 40, typically in conventional fashion, responsive to user input through the pneumatic bed control device 1, as will be hereinafter described.

Figure 1:
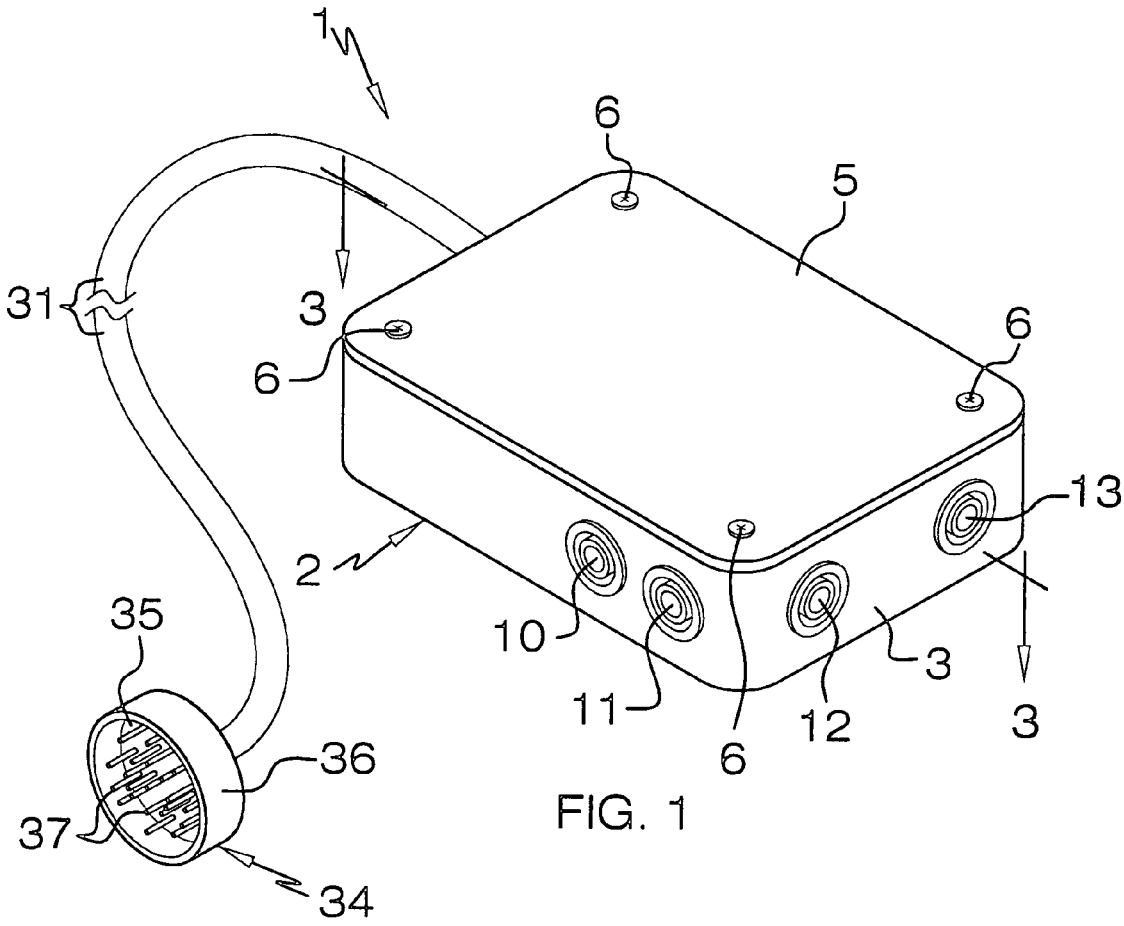
FIG. 1 is a perspective view of an illustrative embodiment of a pneumatic bed control device.
Figure 2:
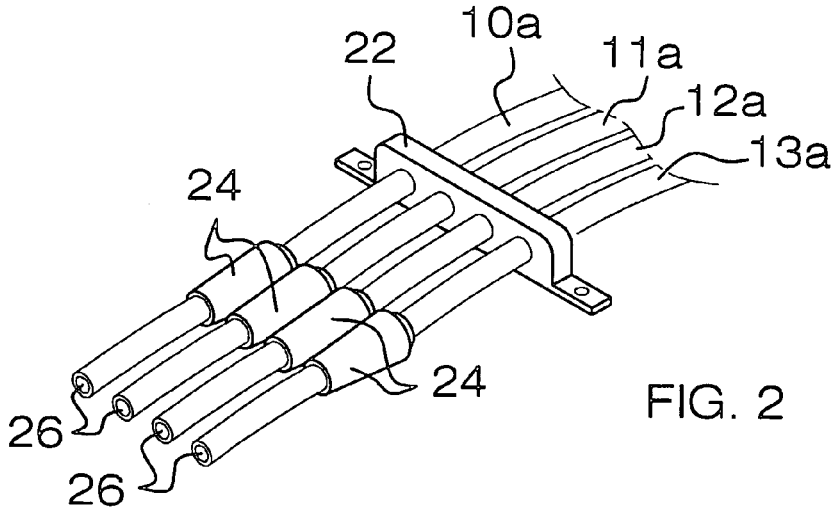
FIG. 2 is a perspective view, partially in section, illustrating multiple puff tubes of an illustrative embodiment of a pneumatic bed control device.

The pneumatic bed control device 1 typically includes a housing 2 having a container 3 with a container interior 4, as shown in FIG. 3. A cover 5 is typically provided on the container 3 to close the container interior 4. As shown in FIG. 1, multiple fasteners 6 may be used to secure the cover 5 on the container 3.

Multiple tube jacks 10-13 are provided on the exterior surface of the housing 2, such as on the container 3. As shown in FIG. 3, each tube jack 10-13 is coupled to a corresponding pneumatic switch 16 which is provided in the container interior 4. Connecting wiring 18 connects the pneumatic switches 16 to each other. Plug wiring 20 is further connected to each of the pneumatic switches 16. The plug wiring 20 exits the housing 2 through a wiring sleeve 30 which extends typically through the container 3 of the housing 2. From the wiring sleeve 30, the plug wiring 20 extends through a wiring sheath 31 that extends from the housing 2. One segment of the plug wiring 20*a* is power wiring which transmits electrical power from the bed motor control box 60 to the pneumatic switches 16.

A plug 34 is provided on the extending or distal end of the wiring sheath 31. The plug 34 may have a Stryker Pendant Port configuration which is known by those skilled in the art and is compatible with a port 46 provided on the bed motor control box 60 of conventional automatically controlled beds 40. As shown in FIG. 4, the plug 34 may include, for example, a plug plate 35 and an annular plug flange 36 which extends from the plug plate 35. Multiple plug contacts 37 extend from the plug plate 35 and are electrically connected to the plug wiring 20 of the pneumatic switches 16, respectively.

As shown in FIG. 5, the plug 34 of the pneumatic bed control device 1 is adapted for electrical connection to a port 46 provided on the bed motor control box 60 of the bed 40. The port 46 includes multiple port contacts (not shown) which are disposed in electrical contact with the respective plug contacts 37 of the plug 34 when the plug 34 is connected to the port 46. The port contacts of the port 46 are connected to circuitry (not shown) in the bed motor control box 60 in such a manner that the various pneumatic switches 16 in the housing 2 of the pneumatic bed control device 1 actuate various movements of the motors (not shown) that actuate the raising and lowering of the head 41 and foot 42 of the mattress 40*a* on the bed 40, according to the knowledge of those skilled in the art. For example, the pneumatic switch 16 coupled to the tube jack 10 may actuate lowering of the foot 42; the pneumatic switch 16 coupled to the tube jack 11 may actuate raising of the foot 42; the pneumatic switch 16 coupled to the tube jack 12 may actuate lowering of the head 41; and the pneumatic switch 16 coupled to the tube jack 13 may actuate raising of the head 41 of the mattress 40*a*.

As shown in FIG. 5, puff tubes 10*a*-13*a* are connected to the tube jacks 10-13, respectively. The puff tubes 10*a*-13*a* typically extend through a tube bracket 22 which is adapted to be mounted on a side rail 43 of the bed 40. Tube spacers 24 may be provided on the puff tubes 10*a*-13*a*, respectively. The puff tubes 10*a*-13*a* terminate in respective tube tips 26 which are disposed in proximity to the head 41 of the bed 40 when the pneumatic control device 1 is mounted on the bed 40. Accordingly, a patient (not shown) can selectively and individually activate each of the pneumatic switches 16 to actuate raising and lowering of the head 41 and foot 42 of the mattress 40*a* through the bed motor control box 60 by blowing into the tube tip 26 of the appropriate puff tube 10*a*-13*a*.

In typical application, the housing 2 of the pneumatic control device 1 is mounted on the bed frame (not shown) of the bed, beneath the bed mattress 40*a*, as shown in FIG. 5. The tube bracket 22 is mounted on one of the side rails 43 of the bed 40. The puff tubes 10*a*-10*d* are extended through the tube bracket 22 and the tube tips 26 positioned in proximity to the head 41 of the mattress 40*a* on the bed 40. Accordingly, by turning his or her head and blowing into the tube tips 26 of the respective puff tubes 10*a*-13*a*, a patient (not shown) lying on the mattress 40*a* of the bed 40 can facilitate selective lowering and raising of the foot 42 and lowering and raising of the head 41, respectively, of the bed 40 depending on the desires of the patient.

Figure 6:
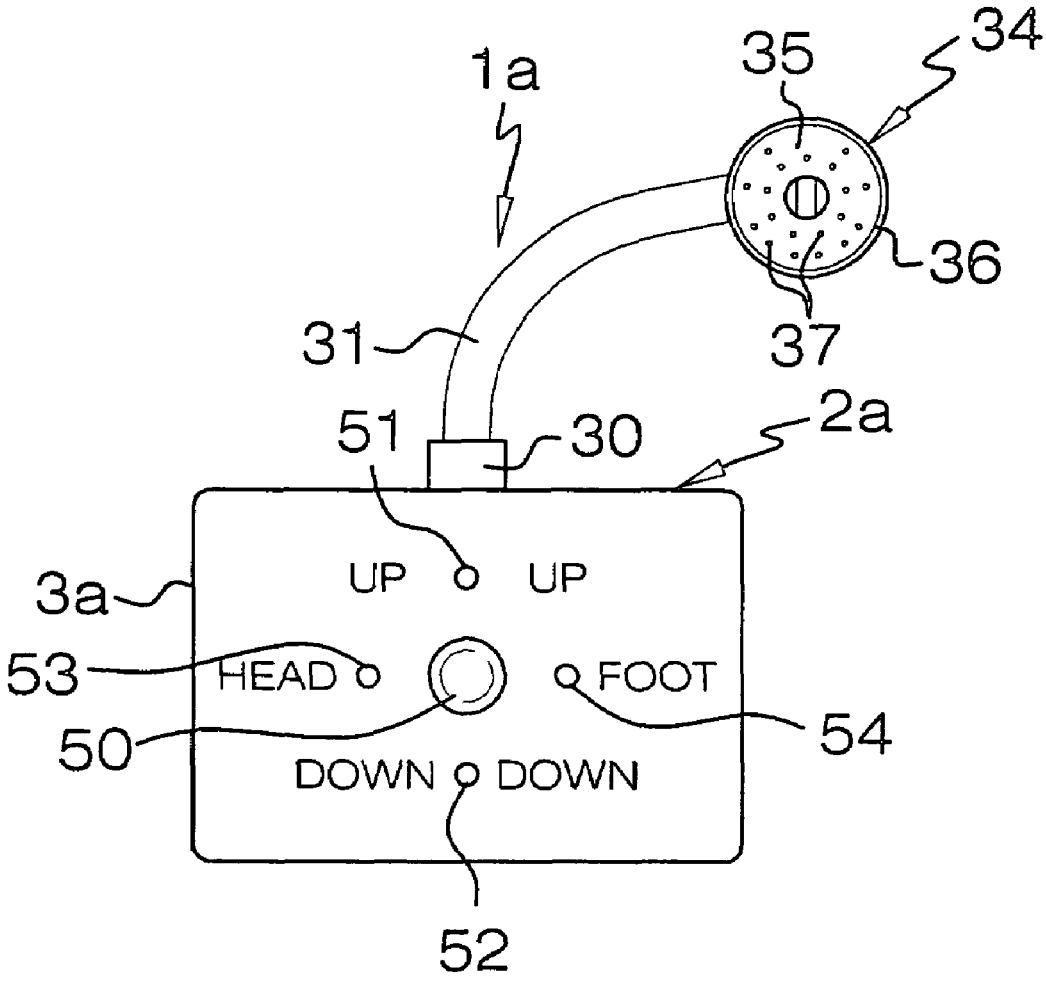
FIG. 6 is a front view of an alternative, joystick-actuated embodiment of a bed control device.

Referring next to FIG. 6, an alternative, joystick-controlled embodiment of a bed control device is generally indicated by reference numeral 1*a*. The bed control device 1*a* includes a housing 2*a* which may have a design that is similar to the housing 2 of the pneumatic bed control device 1 heretofore described with respect to FIGS. 1-5. In the bed control device 1*a*, however, the tube jacks 10-13 and pneumatic switches 16 are replaced by a joystick 50 which is pivotally attached typically to the container 3*a* of the housing 2*a*, and associated electronic circuitry. Various markings or designations, such as an "up" position 51, a "down" position 52, a "head" position 53 and a "foot" position 54, may be provided on the exterior surface of the container 3*a*, in proximity to the joystick 50. The joystick 50 and associated electronic circuitry (not shown) are connected to the plug contacts 37 of the plug 34 through plug wiring (not shown) which extends through the wiring sheath 31 on which the plug 34 is provided. The plug 34 is adapted for connection to the port 46 (FIG. 5) on the bed 40 in such a manner that the joystick 50 is capable of controlling the up and down positions of the head 41 and the foot 42 of the bed 40, according to the knowledge of those skilled in the art. Accordingly, the joystick 50 may be selectively positioned between the "up" position 51 and the "head" position 53 to raise the head 41 of the bed 40; between the "head" position 53 and the "down" position 52 to lower the head 41 of the bed 40; between the "up" position 51 and the "foot" position 54 to raise the foot 42 of the bed 40; and between the "foot" position 54 and the "down" position 52 to lower the foot 42 of the bed 40.

While the preferred embodiments of the invention have been described above, it will be recognized and understood that various modifications can be made in the invention and the appended claims are intended to cover all such modifications which may fall within the spirit and scope of the invention.

What is claimed is:

1. A pneumatic bed control device, comprising:

a housing;

a plurality of pneumatic switches carried by said housing;

a plug having a plug plate, a plug flange carried by said plug plate and a plurality of plug contacts extending from said plug plate and connected to said plurality of pneumatic switches; and a plurality of puff tubes connected to said plurality of pneumatic switches, respectively; and a plurality of tube jacks carried by said housing and wherein said plurality of pneumatic switches is coupled to said plurality of tube jacks and said plurality of puff tubes is connected to said plurality of tube jacks.

2. The device of claim 1 wherein said housing comprises a container and a lid carried by said container.

3. The device of claim 1 further comprising plug wiring connecting said plurality of pneumatic switches to said plug contacts of said plug.

4. The device of claim 3 further comprising a wiring sleeve carried by said housing and wherein said plug wiring extends through said wiring sleeve.

5. The device of claim 4 further comprising a wiring sheath containing said plug wiring.

6. The device of claim 1 further comprising connecting wiring connecting said plurality of pneumatic switches.

7. The device of claim 1 further comprising a tube bracket and wherein said plurality of puff tubes extends through said tube bracket.

8. The device of claim 1 further comprising a plurality of tube spacers provided on said plurality of puff tubes, respectively.

* * * * *